United States Patent [19]

Sniady

[11] 4,121,447

[45] Oct. 24, 1978

[54] STRIPPING APPARATUS

[75] Inventor: Henry Sniady, London, England

[73] Assignee: Metal Box Limited, England

[21] Appl. No.: 804,255

[22] Filed: Jun. 7, 1977

[30] Foreign Application Priority Data

Jun. 11, 1976 [GB] United Kingdom ..... 24189/76

[51] Int. Cl.[2] ..... B21D 45/00

[52] U.S. Cl. ..... 72/344; 72/427

[58] Field of Search ..... 72/344, 345, 427, 361; 10/11 E, 76 T

[56] References Cited

U.S. PATENT DOCUMENTS

| | | | |
|---|---|---|---|
| 2,737,139 | 3/1956 | Smith | 72/344 |
| 3,664,171 | 5/1972 | Paramonoff | 72/344 |
| 3,886,781 | 7/1975 | Paramonoff | 72/427 |
| 3,955,394 | 5/1976 | Kaufman et al. | 72/344 |

*Primary Examiner*—Leon Gilden

[57] ABSTRACT

Apparatus, for stripping an article from an axially reciprocable punch, of a kind having a plurality of segments surrounding the punch, each of said segments having a working surface resiliently urged radially inwards towards the punch and engaged with a piston, said piston being supported by fluid means for limited motion in a piston plate, parallel to the axis of the punch, to enable the working surface of the segment to contact the edge of the article before stripping wherein the improvement resides in a fixed guide means to confine a pivot portion of each segment for pivotal movement in a plane radial to the punch, individual biasing means to urge each segment substantially longitudinally towards the punch, and a cam ring having a surface which engages with a heel portion of each segment to guide the working surface thereof substantially parallel to the punch to engage with the article to be stripped. In one embodiment, return springs act against the segments to permit each segment to be lifted by the article during the forward stroke and retract into the patch of the article for stripping during the return stroke. The fluid used to support the pistons may be provided from the lubrication system of the press.

9 Claims, 13 Drawing Figures

STRIPPING APPARATUS

This invention relates to apparatus for stripping an article from a punch and more particularly, although not exclusively, to apparatus for stripping a thin walled can from the punch of a press tool.

A mechanical apparatus for stripping is described in U.S. Pat. No. 3,735,628 in which a plurality of segments, surrounding the punch carrying a wall ironed can, are resiliently urged radially against the punch, by a spring, so that the can is stripped from the punch during its return stroke. The working surface of each segment is located in a single plane perpendicular to the axis of travel of the punch and therefore only able to impose an even circumferential contact on the trailing edge of the can if the entire trailing edge is also in the plane perpendicular to the axis of the punch. However, drawn or ironed cans often have ears which make the trailing edge uneven and so contact with the stripper segments is localised to a few of the segments and this localised contact gives rise to high stripping forces which damage the edge of the can. British Pat. No. 1,463,026 describes a stripper having a plurality of segments, each of which is independently supported hydraulically, for limited axial movement so that the uneven edge of a can may be contacted evenly all round before stripping. However, as with the mechanical stripper, the segments are mechanically urged radially inwards against the punch surface and so cause continuous wear of the punch and segments. Not only is replacement of the work parts costly but also the production time lost during dismantling and reassembly.

This invention provides apparatus, for stripping an article from an axially reciprocable punch, of a kind having a plurality of segments surrounding the punch, each of said segments having a working surface resiliently urged radially inwards towards the punch and being engaged with a piston, said piston being supported by fluid means for limited motion in a piston plate, parallel to the axis of the punch, to enable the working surface of the segment to contact the edge of the article before stripping, characterised by, a fixed guide means to confine a pivot portion of each segment for pivotal movement in a plane radial to the punch, individual biasing means to urge each segment substantially longitudinally towards the punch, and a cam ring having a surface which engages with a heel portion of each segment to guide the working surface thereof substantially parallel to the punch to engage with the article to be stripped.

In a preferred embodiment the apparatus has a plurality of return springs. Each return spring is held in the fixed guide means, and acts against each segment to permit the segment to pivot during the forward stroke of the punch to permit forward passage of the article and which pushes the segment thereafter into the path of the article in readiness for stripping.

In a further embodiment the hydraulic means for supporting the segments is in the form of a plurality of pistons supported by hydraulic fluid in a header gallery connected through a control valve to a supply of hydraulic pressure, so that the combined motion of the segments against the pistons causes a back pressure in the gallery which closes the control valve and prevents further axial movement of the working surface of the segments.

Various embodiments of the invention will now be described by way of example, and with reference to the accompanying drawings, in which.

Figure 1:
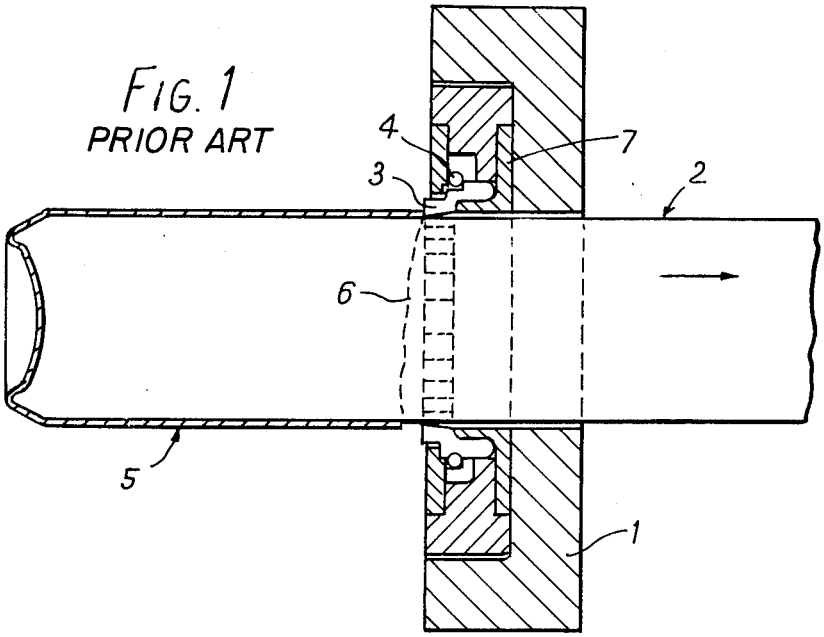
FIG. 1 PRIOR ART
FIG. 1 is a sectioned side elevation of a segmented mechanical stripper according to the prior art.

In FIG. 1 the mechanical stripper 1 surrounds a punch 2 which is shwon during the return stroke as indicated by an arrow. This mechanical stripper comprises a plurality of segments surrounding a punch. Each segment 3 is arranged substantially parallel to the axis of the punch and is resiliently urged to pivot radially inwards upon a fixed member 7, by a garter spring 4 acting towards the end of the segment remote from the pivot point. During forward motion of the punch 2 the wall 5 of a can pushes the segments radially outwards until the free edge 6 of the can passes to permit the segments to pivot radially inwards to engage the punch. During the return stroke (as shown in FIG. 1) the free edge 6 of the can is brought to engage with the segments, but as the free edge 6 is uneven, as indicated by the dashed line, only local contact can be made with the denoted segment 3 which cannot move axially. The high pressures arising, during continued punch travel therefore cause buckling of the free edge until a sufficient number of segments are contacted to achieve stripping. However, the buckled edge may render the can unacceptable to subsequent can making machines and the continuing engagement of the segments with the punch causes punch wear.

Figure 2:
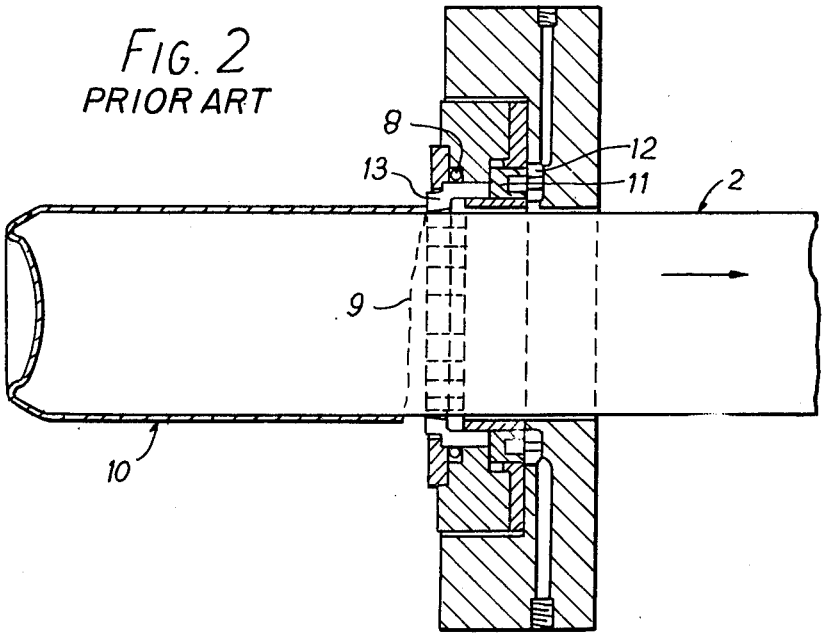
FIG. 2 PRIOR ART
FIG. 2 is a sectioned side elevation of a segmented hydraulic stripper according to the prior art.

The hydraulic stripper described in British Pat. No. 1,465,230 is depicted diagrammatically in FIG. 2. Each segment 13 is resiliently urged by a garter spring 8 to pivot radially inwards in a like manner to that described with reference to FIG. 1 and is also adapted for movement parallel to the punch axis against an hydraulically supported piston. As the uneven edge 9 of the can wall 10 engages a segment 13, the segment moves axially against the piston 11 to displace hydraulic fluid in a common header gallery 12. While the first segment so moves, the edge 9 of the can 10 continues its motion with the punch to coact with the rest of the segments whereon the combined motion of hydraulic fluid, induced in the header gallery 12, by the axial movement of each segment against its respective piston, causes a single control piston (not shown) to shut off an air supply which supports it and arrest the hydraulic flow, and so prevent further axial movement of the segments. This prior art stripper therefore works on a fixed volume of hydraulic fluid. The hydraulic fluid in the header is introduced or replenished through an orifice separate from the control piston orifice. As with the mechanical stripper of FIG. 1 the segments of the hydraulic stripper of FIG. 2 also cause continuing punchwear. Furthermore the provision of hydraulic seals and air control pressure add complication to the stripper.

Figure 4:
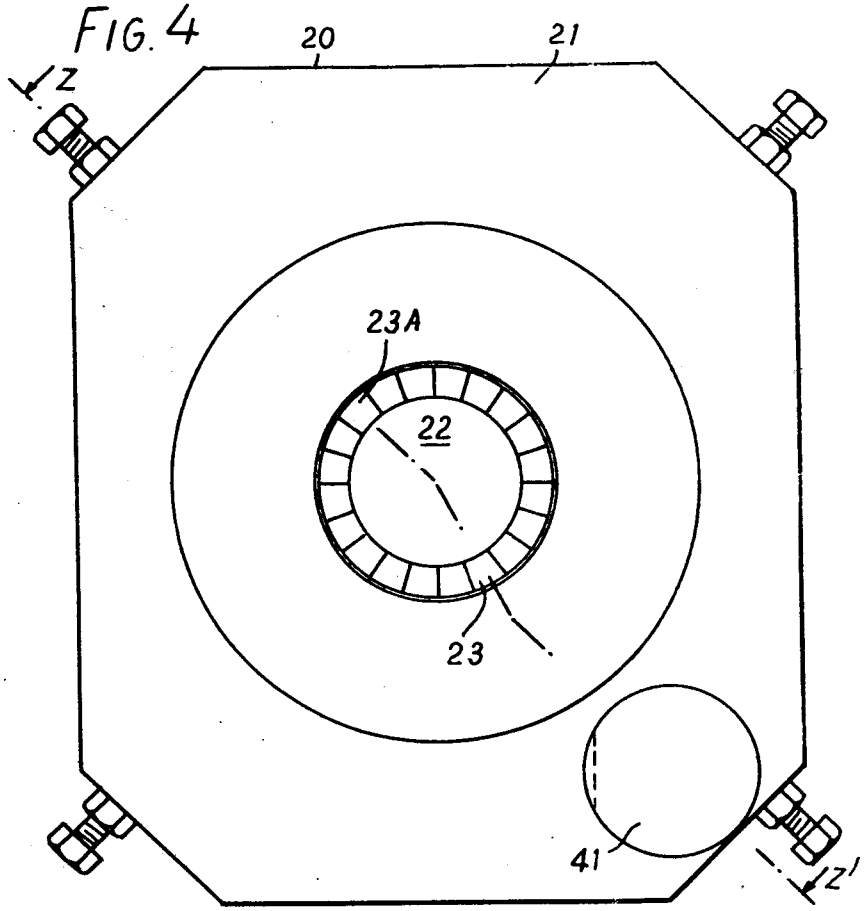
FIG. 4 is an end elevation of the stripper of FIG. 3.
Figure 3:
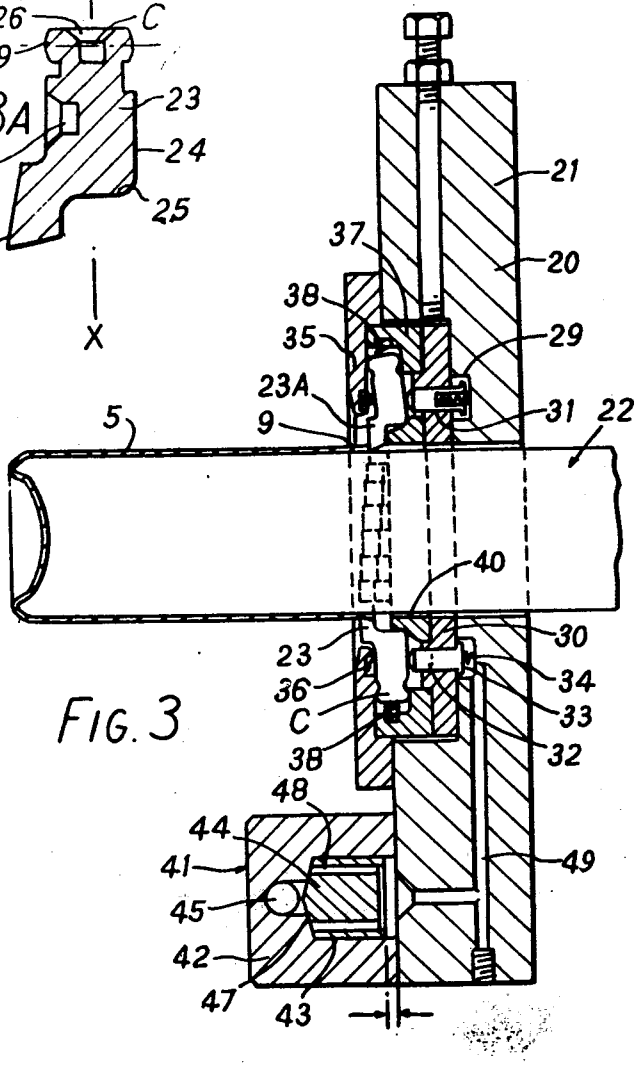
FIG. 3 is a side elevation of a segmented lever type hydraulic stripper, according to the invention, sectioned on line z—z' in FIG. 4.
Figure 3A:
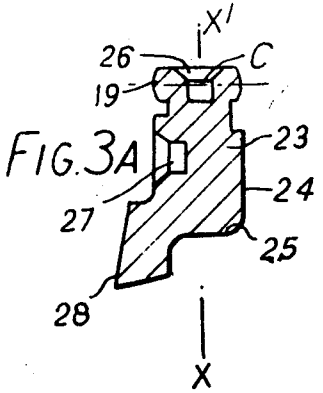
FIG. 3A is an enlarged sectioned side elevation of a segment.
Figure 5:
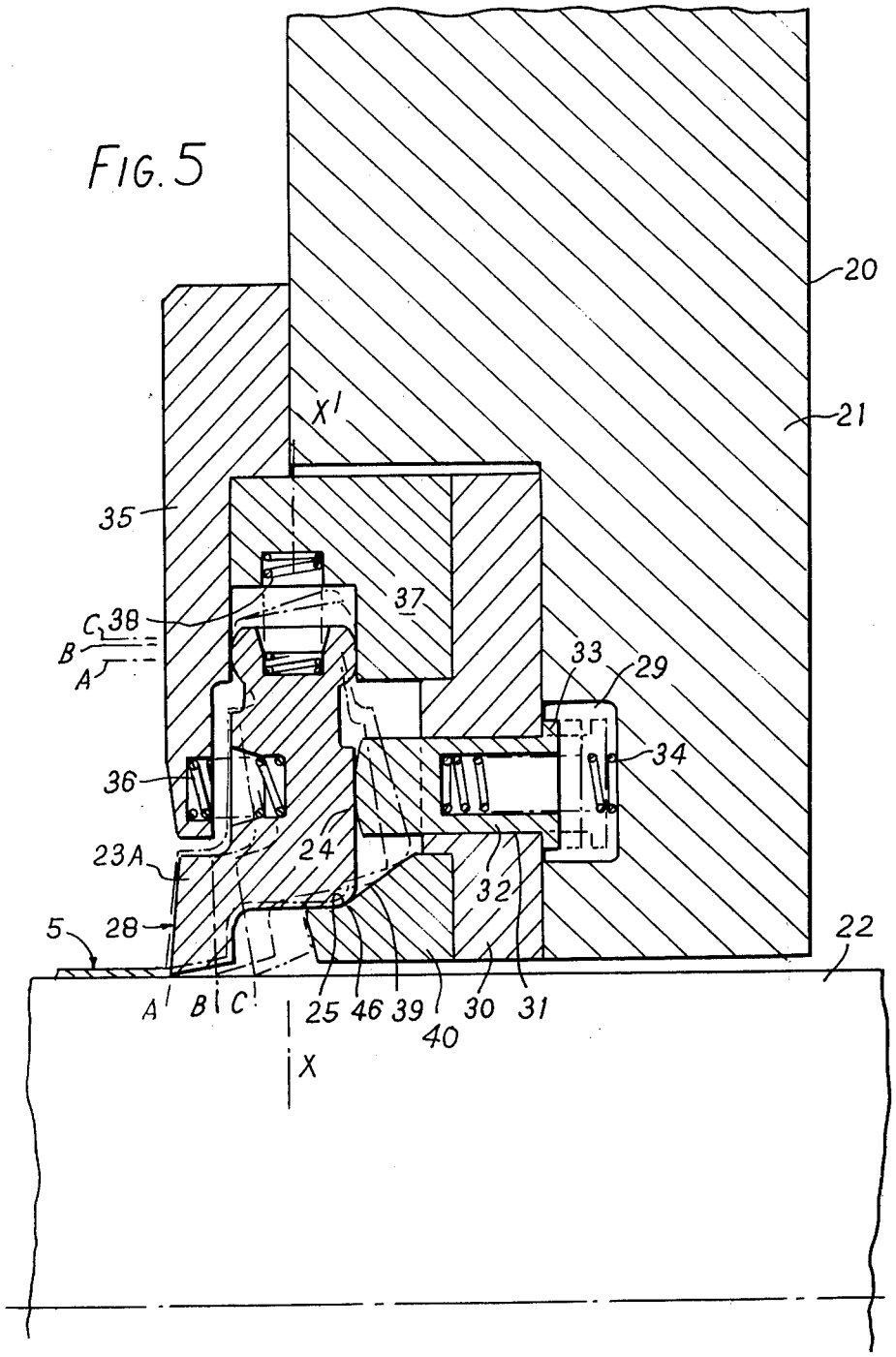
FIG. 5 is a sectioned side elevation showing details of the segment movement against the control cam.

Referring now to FIGS. 3,3A and 4 it will be seen that our improved stripper 20 comprises a base plate 21 which surrounds a punch 22 and carries therein a plurality of segments 23 which work in the manner of levers which are not only pivotable about a point denoted C but also reciprocable along the axis x—x' as indicated in FIGS. 3A and 5. In our stripper the axis of reciprocations x—x' of each segment lies substantially radial to the axis of punch travel in contrast to the prior art. Movement of the segments to engage with the uneven edge 9 of a drawn can wall 5 is achieved by the combination of radial movement and pivoting.

In FIG. 3A the lever segment 23 comprises a pivot portion 19, a back 24, a heel 25, a radial spring hole 26, a return spring hole 27 and a working surface 28.

Referring to FIG. 3, one embodiment of our stripper is shown to have a base plate 21 surrounding a can redrawing punch 22 which passes through it. An hydraulic header 29 in the form of an annular channel in the front face of the base plate 21 is covered by a piston plate 30 which has a plurality of bores 31 extending from the header 29 parallel to the axis of the punch 22. Each bore 31 is provided with a hollow flanged piston 32 which extends through the bore and is arranged so that the flange 33 is within the header 29 so that a piston spring 34 extending from the base of the header channel into the piston 32 urges the piston flange 33 to engage with the piston plate 30. Each piston acts upon the back 24 of a segment 23 to urge it to pivot forward towards a retaining plate 35 against the action of a return spring 36 the precise purpose of which will be explained with reference to FIG. 5. The stripper of FIG. 3 further comprises a radial guide member 37 in the form of a ring which supports a plurality of radially arranged springs 38 each of which extends from the inside of the guide ring 37 into the radial spring hole 26 of a segment 23, and urges the working surfaes 28 of the segment 23 radially inwards towards the punch 22, the inward movement being limited by the engagement of the heel 25 of the segment against a contoured surface 39 of a cam ring 40. Each segment 23 pivots about the pivot portion 19, the cylindrical surfaces of which are held between the surfaces of the retaining plate 35 and the radial guide member 37 while being free to reciprocate radially under the influence of the radial spring 38 and cam ring 40.

A radial conduit 49 extends from the hydraulic header 29 to a control valve 41 which comprises a housing 42 having a cylindrical bore 43 with one end open to the conduit 49 and the other end having a connection 45 to a supply of hydraulic fluid under pressure. A single valve piston 44 is free to reciprocate within the cylindrical bore 43.

Figure 7:
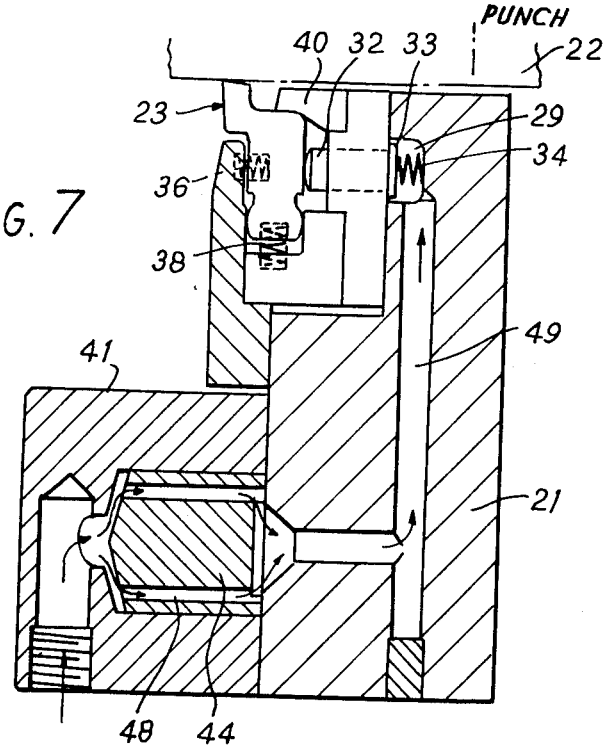
FIG. 7 is a sectioned side elevation showing a segment and the hydraulic piston in the neutral position.
Figure 8:
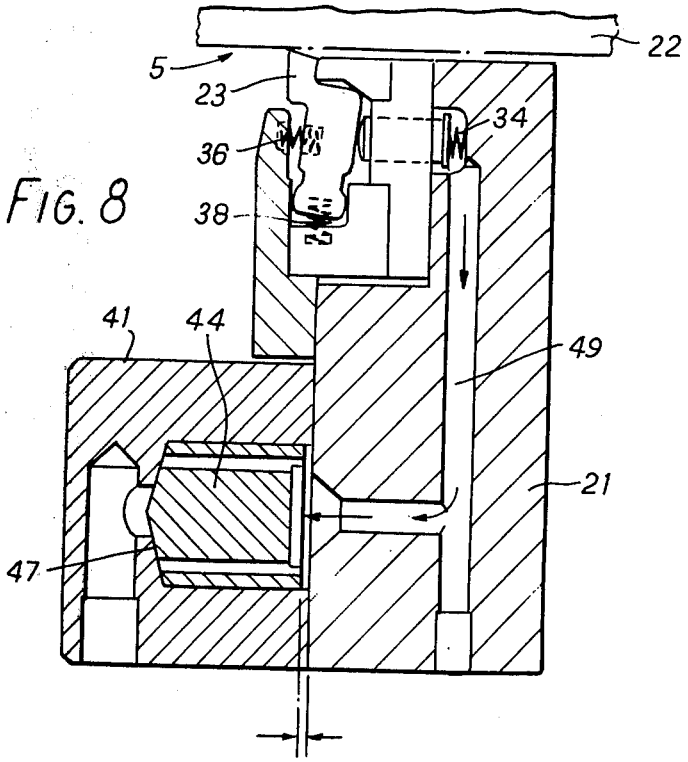
FIG. 8 is a sectioned side elevation showing the segment and hydraulic piston of FIG. 7 in the stripping position.

The stripping of a drawn can wall 5 from the punch 22 will now be described with reference to FIGS. 5, 7 and 8. During the forward stroke of the punch 22, which is from right to left in FIG. 5, the working surface 28 of a segment such as that denoted 23A is lifted by the can wall 5 against the action of the return spring 36. In this extreme forward position the back 24 of each segment 23 is free from the piston 32. After the can wall 5 has passed the segments, such as 23, on the forward stroke, each segment is moved radially inwards, by its radial spring 38, into the path of the uneven edge 9 of the can wall 5 on the return stroke. In position of readiness, as indicated by the letters A in FIG. 5, the working surface 28 of the segment 23 is in the path of the approaching edge 9 of the wall 5, the heel 25 is on the corner 46 of the cam surface 39, the pivot point "C" is at its closest radial position to the punch 22 and the back 24 of each segment is in contact with its respective piston 32. On the return stroke of the punch the uneven edge 9 of the can wall engages with the working surface 28 of a segment 23A in position A. Continued rearwards motion of the can edge pushes the working surface 28 of segment 23A axially and the heel 25 of the segment 23A starts to climb the cam counter through the intermediate position B to the arrest position C. The cam contour 39 guides the working surface 28 of all the segments 23 in a path substantially parallel to the axis (and therefore parallel to the surface of the punch 22) as the back 24 of the segment pushes the piston 32 into the hydraulic header 29 to displace hydraulic fluid from the header into the control valve 41. As the first segment 23A moves the can edge is able to contact the other segments 23 which in turn displace fluid until the accumulated movement of hydraulic fluid from the header 29 closes the valve piston 44 against a seat 47 in the control valve 41 as shown in FIG. 8. The trapped volume of hydraulic fluid then arrests any further segment movement and the can is evenly stripped. Once the can has been stripped the pressure on the working surface of the segments is removed and the piston springs 34 urge the pistons 32 against the segments 23 to move them forward and reduce the pressure in the header 29. The supply pressure then forces the valve piston 44 from the seat 47 to permit hydraulic fluid to flow into the header 29, through bores 48 in the valve piston 44. The stripper is then ready for the next stripping operation, as shown in FIG. 7.

Whilst the stripper may be supplied from any convenient pressure line it is customary on wall ironing presses to use a continuous supply of a lubricant/coolant to the tool block. This lubricant/coolant is supplied at a pressure of the order of 20 psi and may conveniently be tapped to operate our stripper. As the supply is copious and continuous the pistons of the stripper and their bores may be machined to ordinary tolerances which would leak to a degree unacceptable in a closed hydraulic system. Not only is this a useful economy but also the leakage serves to provide lubrication for the moving parts of the stripper.

Figure 6:
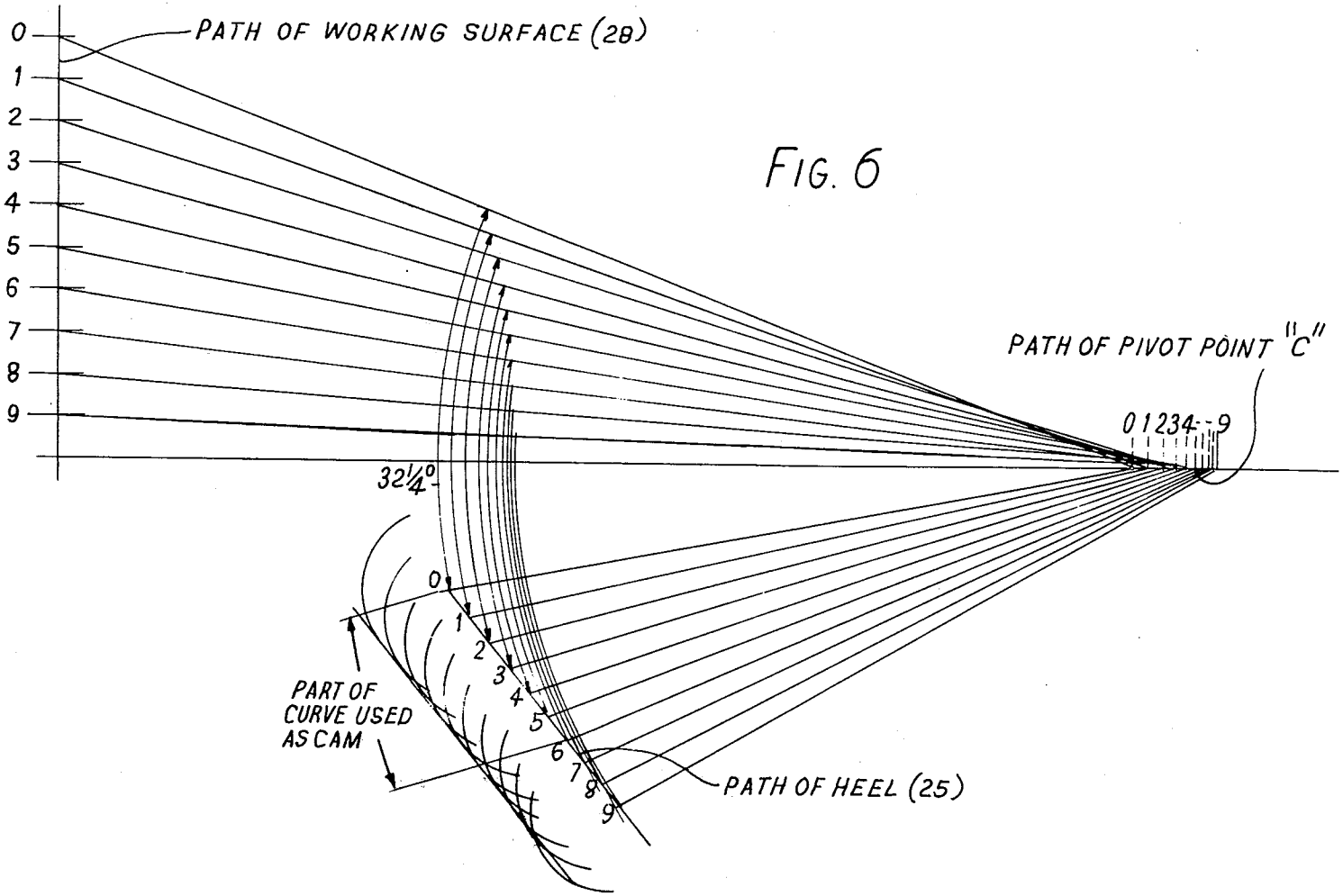
FIG. 6 is a diagram showing the development of the control cam surface of FIGS. 3 and 5.

FIG. 6 shows the theoretical development of the cam contour. One object of our invention is to move the working surface 28 of the segments 23 in a path parallel to the punch surface to avoid wear. In FIG. 6 this path is denoted by the numbers 0 to 9 on the line denoted "path of working surface". This distance between the tip of working surface 28 and pivot point "C" of the segment is fixed and denoted by lines joining the respective points (0,1,2) on the patch of the working surface 28 to their respective points (0'1'2' etc.) on the line denoted "path of pivot point "C"". The path of pivot point C is guided to be radial to the punch by means in the form of the guide ring 37 and retaining plate 35. If notional lines are drawn between the working surface point 28 and pivot centre "Y" and between the heel 75 and the pivot centre, the angle between them is constant. This angle is shown in our example to be 34¼° and as the distance of any point of the heel from the pivot centre is fixed the path of the heel 25 can be plotted (as shown in FIG. 6) in relation to the paths of the working surface and pivot centre. Points 7, 8 and 9 demonstrate that this theoretical path of the heel 25 is not a straight line, however, for practical purposes it is possible to use that part of the heel line, including points 1 to 6, which approximate to a straight line and so the cam surface 39 can, if desired, be frustoconical.

The provision of a cylindrical portion on the cam, on which the heel 25 rolls during the forward passage of a can wall is a desirable feature because it restrains the inward motion of the segment and so reduces any risk of scratching the can.

In the embodiment described with reference to FIGS. 3 to 8, each segment has a pair of side walls which extend in a radial direction from the axis of the punch so that, when assembled in the stripper each segment supports the next segment to achieve the full circle of segments surrounding the punch. Although the pivot portion of the segment is restrained from axial motion by the retaining plate 35 and the guide member 37, the radial springs 38 and return springs 36 can provide only some restraint to prevent each segment moving circumferentially around the punch. There remains the possibility that the segments may move circumferentially from the position of alignment with their respective pistons 32. Prior art strippers are known which have fixed separator plates to hold the segments in group which cannot move circumferentially. British Pat. No. 1,440,749 describes one such arrangement. In FIGS. 9 to 12 an alternative embodiment of our invention is depicted which applies this principle of circumferential restraint by separating each segment from the next.

Figure 9:
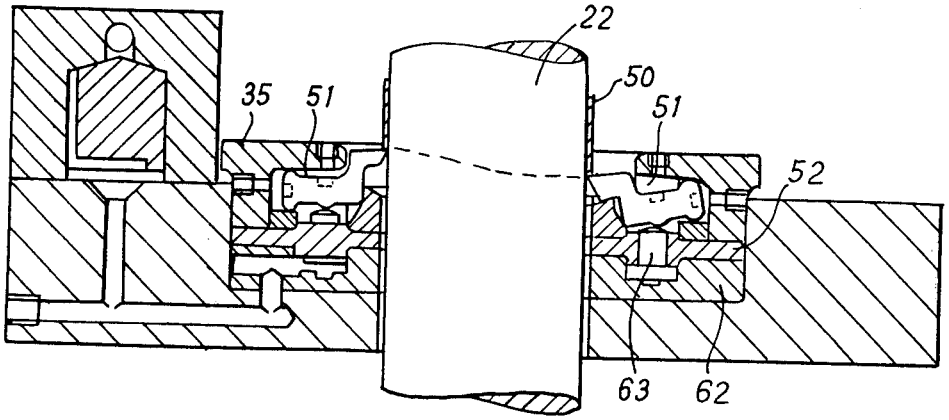
FIG. 9 is a side elevation of an alternative embodiment sectioned upon the line x—x' in FIG. 10.
Figure 10:
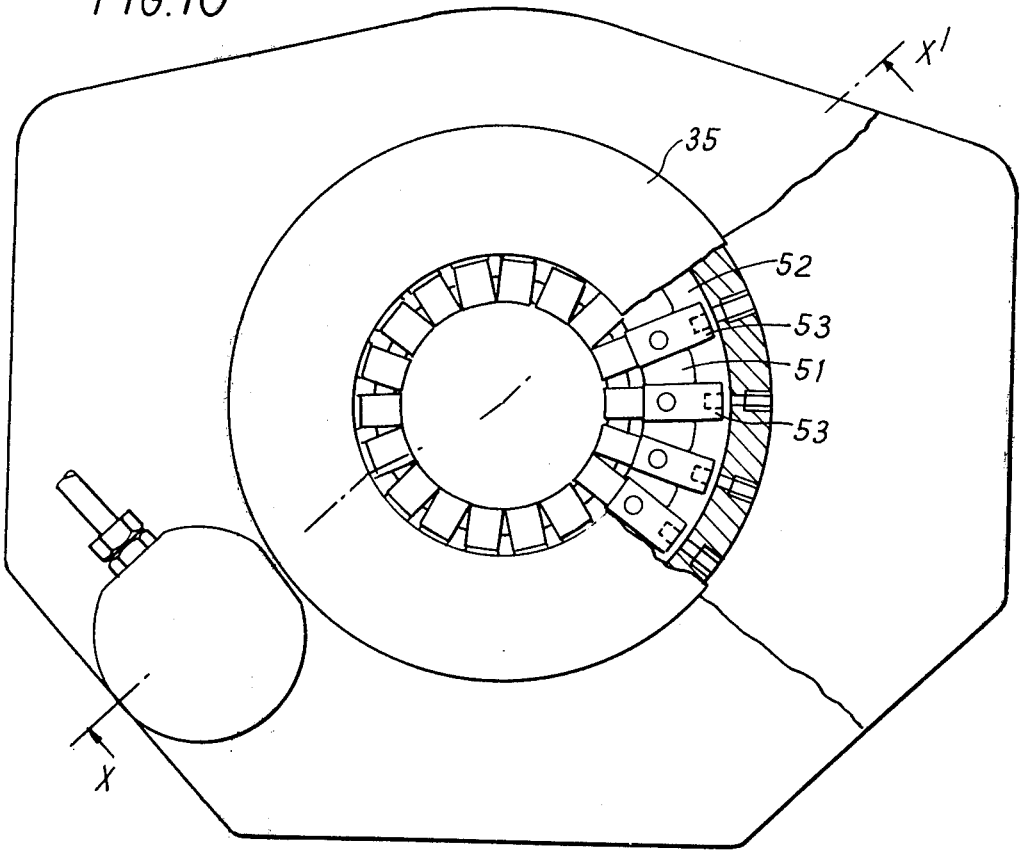
FIG. 10 is a front view of the embodiment of FIG. 9.

The alternative embodiment of our stripper depicted in FIGS. 9 and 10 works in a similar way to the embodiment described with reference to FIGS. 3 to 8, in order to strip a can body 50 (shown in part only) from the punch 22. The difference resides in the provision of spacer blocks 51, which extend from the face of a modified piston plate 52, in a direction parallel to the axis of the punch 22, to separate each segment 53 from the next. In FIG. 10 the retaining plate 35 is depicted with part cut away to show how each segment 53 lies radially between a pair of spacer blocks 51.

Figure 11:
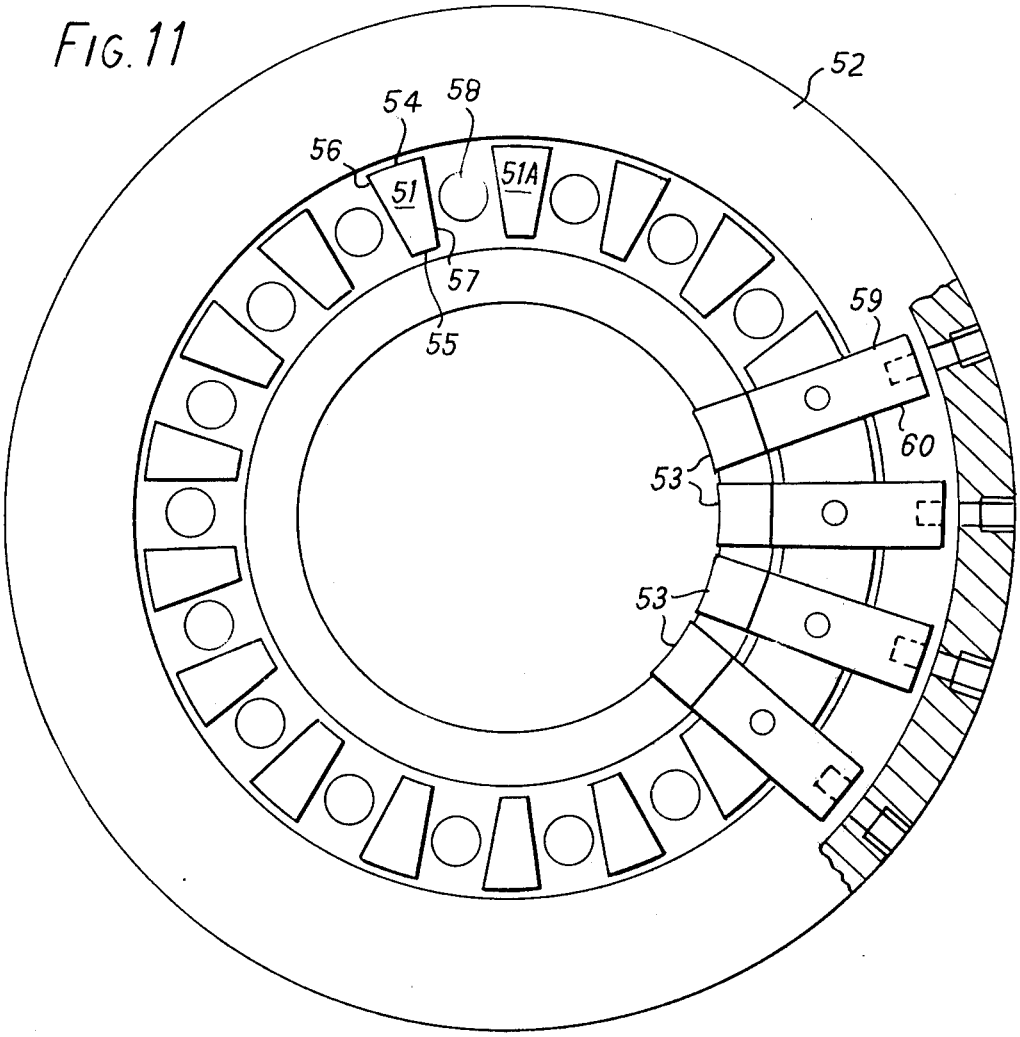
FIG. 11 is an enlarged front view of the piston plate.
Figure 12:
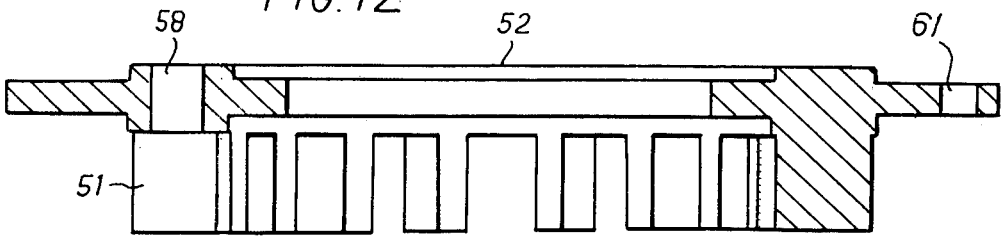
FIG. 12 is a side elevation of the piston plate of FIG. 11.

FIGS. 11 and 12 show the modified piston plate 52 on an enlarged scale. Referring to FIG. 11 it will be seen that each spacer block 51 is substantially trapezoidal in cross-section. The parallel or alternatively concentric faces (54, 55) of each block are radially apart in relation to the axis of the punch. The side walls 56, 57 of each block extend in a direction parallel to a radius line extending from the axis of the punch and passing through the axis of the bore 58 centrally placed between the block 51 and the next block 51A. To the right of FIG. 11, four segments 53 are shown in situ between their respective spacer blocks. Each segment has a pair of parallel sides 59, 60 which slidably engage with the side walls of the adjacent spacer blocks.

The piston plate has holes, such as the one denoted 61 depicted to the right of FIG. 12, which enable the piston plate to be bolted to a plate 62 which includes the channel for the hydraulic fluid which supports the pistons 63 (best seen in FIG. 7). The pistons slide within the bores 58 during the operation of the stripper to act in the manner hereinbefore described with reference to FIGS. 3 to 8. To achieve clarity in the drawings, the fixing studs and bolts have been omitted.

It will be understood that the cam may be subject to wear due to frictonal engagement with the segments. The cam is therefore made readily replaceable; however the cost of replacement is much less than that of replacing the punch or even the segments.

What I claim is:

1. Apparatus for stripping an article from an axially reciprocal punch, of a kind having a plurality of segments surrounding the punch, each of said segments having a working surface resiliently urged radially inwards towards the punch and having a portion of each segment engagable with a respective piston, each piston being supported by fluid means for limited motion in a piston plate, and disposed parallel to the axis of the punch, to enable said working surface of each segment to contact the edge of an article before stripping, wherein the improvement resides in a fixed guide means having a portion defining a socket to confine a pivot portion of each segment for pivotal movement in a plane radial to the punch, individual biasing means positioned within said socket portion and engaging said pivot portion to resiliently urge each respective segment substantially longitudinally towards the punch, and a cam ring having a surface which engages with a heel portion of each segment to guide said working surface thereof substantially parallel to the punch to engage with the article to be stripped.

2. Apparatus according to claim 1 wherein a plurality of return springs each is positioned within an extension of said fixed guide means to resiliently act upon a respective segment to permit said segment to pivot during the forward stroke of the punch thus allowing passage of an article and urging engagement of said segment working surface with the article to facilitate stripping of the article from the punch during the return stroke of the punch.

3. Apparatus according to claim 1 wherein said cam ring surface is that generated by rotation of an arc of a circle about the axis of the punch, the radius of said circle being equal to the distance from the tip of the working surface to the pivot centre.

4. Apparatus according to claim 1 wherein said cam ring surface is frustoconical.

5. Apparatus according to claim 1 wherein said cam ring has a cylindrical portion extending forward from said cam ring surface.

6. Apparatus according to claim 1 wherein a spacer block, extending axially forward from said piston late separates each segment from the next.

7. Apparatus according to claim 6 wherein each spacer block has a pair of opposing sides each extending parallel to a radius extending from the axis of the punch, and each side is engaged with a side of an adjacent segment.

8. Apparatus according to claim 1 wherein the fluid means supporting the pistons is a hydraulic fluid.

9. Apparatus according to claim 1 wherein a valve supplies the fluid means to apparatus from the lubricating system of the punch during the forward stroke of the punch and said valve closes during stripping.

* * * * *